US011664181B2

(12) United States Patent
Kliem

(10) Patent No.: US 11,664,181 B2
(45) Date of Patent: May 30, 2023

(54) BASE PLATE, ELECTRONIC COMPONENT, AND METHOD

(71) Applicant: Thomas Kliem, Rottweil (DE)

(72) Inventor: Thomas Kliem, Rottweil (DE)

( * ) Notice: Subject to any disclaimer, the term of this patent is extended or adjusted under 35 U.S.C. 154(b) by 92 days.

(21) Appl. No.: 17/247,745

(22) Filed: Dec. 22, 2020

(65) Prior Publication Data

US 2021/0193417 A1 Jun. 24, 2021

(30) Foreign Application Priority Data

Dec. 22, 2019 (DE) ..... 10 2019 135 651.2

(51) Int. Cl.

| | |
|---|---|
| ***H01H 3/00*** | (2006.01) |
| ***H01H 50/02*** | (2006.01) |
| ***H01H 50/04*** | (2006.01) |
| ***H01H 50/14*** | (2006.01) |

(52) U.S. Cl.
CPC ..... *H01H 50/021* (2013.01); *H01H 50/048* (2013.01); *H01H 50/14* (2013.01)

(58) Field of Classification Search
CPC .... H01H 50/021; H01H 50/048; H01H 50/14; H01R 43/205; H01R 12/724; H01R 12/585
USPC ..... 335/202
See application file for complete search history.

(56) References Cited

U.S. PATENT DOCUMENTS

| | | | | |
|---|---|---|---|---|
| 4,875,865 | A * | 10/1989 | Demler, Jr. | H01R 12/716 439/578 |
| 4,975,069 | A * | 12/1990 | Fedder | H01R 12/775 439/497 |
| 5,195,899 | A * | 3/1993 | Yatsu | H01R 13/6474 439/607.07 |
| 6,078,491 | A * | 6/2000 | Kern | H01H 50/021 361/167 |
| 6,390,832 | B1 * | 5/2002 | Kuo | H01R 12/716 439/541.5 |
| 6,435,912 | B1 * | 8/2002 | Zhu | H01R 12/725 439/607.23 |
| 6,565,369 | B1 * | 5/2003 | Schulz | H01R 12/714 439/108 |
| 6,575,774 | B2 * | 6/2003 | Ling | H01R 13/53 439/607.09 |
| 6,764,315 | B2 * | 7/2004 | Ng | H01R 12/714 439/607.05 |

(Continued)

FOREIGN PATENT DOCUMENTS

| | | |
|---|---|---|
| DE | 1690028 B1 | 12/1972 |
| DE | 4413947 A1 | 10/1995 |
| DE | 102005043033 | 4/2007 |

*Primary Examiner* — Mohamad A Musleh
*Assistant Examiner* — Lisa N Homza
(74) *Attorney, Agent, or Firm* — Smartpat PLC

(57) ABSTRACT

A base plate for an electronic component, in particular an electronic relay, has a plate-shaped base body, in particular made of plastic, and at least one electrical contact. The electrical contact fully extends through the base body. At one end the electrical contact forms an electrical terminal of the electronic component, in particular of the relay. At another end the electrical contact has an electrically conductive connection section which can be connected to a circuit board without soldering, in particular by being pressed into the circuit board, to form a permanent electrical connection.

13 Claims, 9 Drawing Sheets

(56) References Cited

U.S. PATENT DOCUMENTS

| | | | | |
|---|---|---|---|---|
| 8,951,070 | B1 * | 2/2015 | Goodwin | H01R 12/721 439/660 |
| 9,024,581 | B2 * | 5/2015 | McGinley | H02J 7/0042 320/111 |
| 2002/0117330 | A1 * | 8/2002 | Eldridge | G01R 1/07314 257/E21.507 |
| 2003/0124879 | A1 * | 7/2003 | Ng | H01R 12/714 439/66 |
| 2005/0026469 | A1 * | 2/2005 | Ice | G02B 6/4277 439/76.1 |
| 2009/0203237 | A1 * | 8/2009 | Demonica | H01R 12/7052 439/78 |
| 2009/0203269 | A1 * | 8/2009 | Jenne | H03K 17/9505 439/862 |
| 2013/0141831 | A1 * | 6/2013 | Lee | H05K 5/0039 361/206 |
| 2014/0120749 | A1 * | 5/2014 | Drew | H05K 1/0278 439/78 |
| 2016/0043486 | A1 * | 2/2016 | Wuerstlein | H01R 12/7076 439/78 |
| 2016/0079722 | A1 * | 3/2016 | Ewing | H01R 13/6675 439/638 |
| 2019/0245284 | A1 | 8/2019 | Mukoyama et al. | |

* cited by examiner

BASE PLATE, ELECTRONIC COMPONENT, AND METHOD

CROSS-REFERENCE TO RELATED APPLICATION

This application claims priority of German patent application DE 10 2019 135 651.2 which is incorporated by reference herein.

TECHNICAL FIELD

The disclosure relates to a base plate for an electronic component, in particular an electronic relay. The disclosure also relates to a relay with a base plate and a method for the electrical and mechanical connection of a base plate to a circuit board of a relay.

BACKGROUND

Electronic circuits are often housed in relay housings. A standardized system is usually used, which defines the interface to the mating connector in the form of terminal arrangement and terminal geometry according to the relevant ISO standards 7588 or 8092.

Electromechanical relays are manufactured in millions of pieces and in some cases also fully automatically. This is usually not the case with electronic relays. This is due, on the one hand, to the number of different variants and, on the other hand, to manufacturing challenges. In electromechanical relays, the relay coil body is often already connected to some of the contacts. Different electromechanical relays are typically very similar in terms of structure and number of pins, so that their manufacture can be automated more easily.

There are various approaches to manufacturing electronic components.

According to a first approach, individual contacts are mounted on the circuit board and then soldered. These contacts are then fixed and aligned by a plastic plate. In some cases, the contacts also have a type of latching so that they can be fixed in the base plate. Thereby, mechanical forces that arise during installation of the module or from vibration during operation can be absorbed.

According to a second approach, a circuit board is mounted directly on a base plate in a spatially parallel manner. With this concept, standard contacts are soldered onto the circuit board and then mounted in the base plate. The unbundling then takes place on the circuit board. Smaller circuits can then also be implemented directly here. Due to the fact that the contacts are soldered on the circuit board, the available area is comparatively small depending on the number of contacts. Also, wired components such as relays can be placed only with increased effort.

Both approaches have the disadvantage that the contacts or the base plate must be aligned during installation. If the contacts are not installed at right angles or according to specification, mechanical forces are transferred to the printed circuit board and can damage the soldered joints, which can lead to premature failure of the component. Both approaches therefore do not allow economically viable automated production at smaller quantities. Also, due to the fact that more and more functions have to be integrated into these comparatively small electronic components and the space on the printed circuit board is very limited, new manufacturing techniques have to be developed.

SUMMARY

This paper shows how an electronic component, in particular an electronic relay, can be produced in an automated process with reduced production effort.

A base plate for an electronic component, in particular an electronic relay, has a plate-shaped base body. The base body may in particular be made of plastic. At least one electrical contact completely penetrates the base body. The electrical contact at one end forms an electrical terminal of the electronic component, in particular of the relay. At the other end the electrical contact has an electrically conductive connecting section which can be connected to a circuit board without soldering, in particular pressed into the circuit board, to form a permanent electrical connection.

This solution replaces mechanically fragile soldered connections with a different type of electrical and mechanical connection. It makes use of press-fit technology in the field of electronic components, particularly relays. With press-fit technology, there are different options for creating a press-in zone on the contact. The press-in zone can preferably be designed as a force-receiving section on the outer edge or in the surface of the contacts. The contacts are preferably designed with an angular, in particular rectangular, square cross-section. In principle, contacts with a round cross section are also possible. The solder-free connection between the base plate and the printed circuit board allows electronic relays with the described base plate to be produced in an automated process. In addition, the manufacturing effort of the relay is reduced in an advantageous manner by completely dispensing with soldered connections between the circuit board and the contacts of the base plate. The press-fit technique also has the advantage that the contact resistance of a press-fit connection is significantly lower than that of a soldered joint. When using power electronics, this technology reduces the heat generated by the component and thus increases the efficiency of the component.

The connecting section can be single-ended, double-ended or multi-ended. Each end can be separately connected to the circuit board, in particular can be pressed into the circuit board. Depending on the desired functionality of the relay, different contacts can have connecting sections configured differently with regard to the number of their ends. The individual ends are designed in the form of a pin. The various pins of a connecting section preferably extend at a distance and parallel to one another in the same direction. The pins can be angular and/or round in cross section. Likewise, the connection points of the circuit board that correspond to the pins can also be designed to be correspondingly round and/or angular, depending on the cross-sectional geometry of the respective pin.

According to a preferred embodiment, at least one of the contacts is angled. The section of the contact that forms the terminal of the relay extends in a different direction than the connecting section used for connection to the circuit board. Both sections preferably extend at right angles to one another. For this purpose, the individual sections of the contact are preferably bent at the desired angle to one another. The press-fit technology automatically aligns the base plate with the circuit board when it is connected to the circuit board, preferably at right angles. The components on the circuit board do not have to be heated again. This reduces the stress on the components.

According to a preferred embodiment, it is provided that the connecting section extends, at least in certain areas, essentially parallel to a flat side of the base body facing it.

As a result, the connecting section can be inserted into a corresponding opening in the circuit board by linear movement of the base plate and/or the contact. Complex movements in more than one direction are avoided, which is advantageous with regard to the automation of the manufacturing process of the relay.

According to a preferred embodiment, the electrical contact and/or the base body has a force-receiving section which extends non-parallel at an angle, in particular at a right angle, to the connection section. This allows introduction of force that other than through one of the ends of the contacts. This is the case in particular when the contacts are designed at an angle in order to achieve an angled, preferably right-angled, alignment between the base plate and the circuit board in the relay. If, in this case, the forces necessary for pressing are to be transferred to the circuit board via the base plate or the contacts, force receiving sections must be defined. Due to the geometric configuration of the contacts, however, the force cannot be applied linearly to the contact at one end. Instead, the contact has specially designed force-receiving sections via which the press-in force can act on the contact. In addition, it can be provided to move the base plate linearly (horizontally or vertically) in the direction of the circuit board. Alternatively, the circuit board can also be moved linearly in the direction of the base plate for the purpose of connection. A force-receiving section can be provided by an edge or a flat side of the contact and/or of the base body. A force-receiving section itself can be designed as an edge section, side section and/or as a recess, in particular as a notch. A notch can be linear or punctiform. A linear notch offers the advantage of a homogeneous introduction of force over a larger area. Comparatively high forces can be transmitted selectively to the contact and/or the base body via a punctiform notch.

The press-in can take place exclusively or additionally via the contacts. For this purpose, at least one punch is preferably provided which acts on the at least one contact for the purpose of pressing in. Alternatively, a force transmitter is preferably provided in the form of a separate component, in particular a mask, which is pushed over the contacts. For this purpose, the force transmitter is preferably geometrically formed on the at least one contact, preferably on a plurality of contacts.

According to a preferred embodiment, it is provided that the force-receiving section is designed to extend between the base body and the connecting section. The force-receiving section is preferably formed in the contact. This improves the introduction of force into the contact. In particular, in the case of an angled configuration of the contact, undesirable opposing lever effects are avoided.

The contacts can basically have any cross-sectional geometry. The contacts can in particular have an angular or round cross section. The electrical contact may be designed as a plate-shaped rod. The rod has a rectangular cross section, at least in some areas. The rod also has a rectangular outer contour, at least in some areas. The force-receiving section is preferably formed by at least one of the narrow edges of the rod. According to an alternative preferred embodiment, the force-receiving section is in a flat section of the rod. The contact preferably has a right-angled cross section. This improves the transmission of force to the contact. The force-receiving section preferably extends between the connecting section and the end of the contact which forms the relay terminal.

The contact is preferably made of an electrically conductive material, preferably a metal, in particular copper. Alternatively, the contact can be made of any material, in particular a plastic, and coated with an electrically conductive material, preferably a metal, in particular copper. The base body of the base plate is preferably made of an electrically insulating material, preferably a plastic.

The contacts are preferably guided in the base body. This is used for the precise alignment to the circuit board. They are more preferably anchored in the base body. This has the advantage that the contacts cannot be pushed out of the base body while pressing them into the circuit board.

An electronic component, in particular a relay, preferably an electronic relay, includes the disclosed base plate and a circuit board. The base plate and the circuit board are arranged to one another in such a way that the flat side of the base body of the base plate and the flat side of the base body of the printed circuit board extend substantially at right angles to one another. The printed circuit board has at least one contact point into which the connecting section of the at least one contact of the base plate is pressed for electrical and mechanical connection.

The use of the press-fit technique advantageously creates the electrical connection between the circuit board and contact of the base plate and the mechanical fastening and alignment of the base plate on the circuit board at the same time. This is made possible by the use of the base plate as described. The component, in particular a relay, can be produced in an automated method by that design. In this way, manufacturing effort and costs can advantageously be reduced.

According to a preferred feature of the component, in particular a relay, the contact point is designed as a bore and/or as a slot. The slot is preferably designed as a color. The bore and/or the slot are preferably coated on the inside with a conductive material, in particular copper. As an alternative to a coating, it is possible to equip the bore with a sleeve made of a conductive material, in particular copper, which provides a receptacle for the connecting section of the contact. The contact point here has an inner circumference which is smaller than the outer circumference of the connecting section of the contact. During the press-in process, the connecting section of the contact is pressed into the contact point and fixed in place which causes a material displacement. The conductive material of the contact point is preferably displaced. The displacement can be an irreversible material removal. Depending on the applied pressing force, a desired cold welding can occur between the connection section and the contact point. This further improves the stability of the connection. Alternatively, the connecting section and/or the contact point is at least partially compressible at right angles to the press-in direction. This can be done in particular by applying a spring bias. In this case, the fixation can be realized without removing material.

It can preferably be provided that the contact point is designed in the form of a through hole contacting. In the context of the invention, a "through hole contacting" denotes an electrical connection between different layers of a circuit board by means of a bore.

A method for electrically and mechanically connecting the base plate and the circuit board of the electronic component includes the following steps:

Arranging the base bodies of the base plate and the circuit board by a positioning device such that they are aligned at a right angle to one another and such that the connecting section of the contact of the base plate is positioned over the contact point of the circuit board so that the connecting section and contact point are aligned, exerting, by a pressing device, a force on the force-receiving section of the base plate and/or the contact in the direction of the circuit board, and pressing the connecting section into the contact point to form a solder-free electrical connection between the connecting section and the contact point in a single step and mechanically fix the base plate to the circuit board.

The method completely dispenses with the formation of soldered connections when forming the electrical connection between the contacts of the base plate and the circuit board. Instead, it uses only the pressing of the contacts of the base plate into the contact points of the circuit board. This allows the method to be performed completely automated. Manufacturing effort and manufacturing costs for the relay are considerably reduced as a result. Even in view of a shortage of skilled workers and high wage costs the relay can so be manufactured in a significantly more cost-effective manner, in higher quality and in larger numbers.

According to a preferred embodiment, the pressing device has a press punch which is brought into engagement with the force-receiving section during the pressing process. The engagement can preferably be tight fitting. For this purpose, the press punch has a receptacle designed to correspond to the force receiving section, in particular a receptacle slot. On the one hand, this simplifies the positioning of the press punch relative to the force-receiving section. The receptacle therefore acts as a positioning aid. Furthermore, the frictional engagement prevents the press punch from slipping during the pressing process; especially in an automated process. The press punch can be brought into engagement directly with the force-receiving section. Alternatively, the press punch can be indirectly brought into engagement with the force-receiving section with the interposition of an aforementioned force transmitter.

According to a preferred embodiment the positioning device and/or pressing device may be robots which carry out the positioning and the pressing. The positioning device and the pressing device can be designed as separate robots. Alternatively, both devices can be designed as a single robot. This automates the process further. Production effort and production costs for the relay are thereby further reduced.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

With reference to the following figures, it should be noted that the same reference symbols denote the same elements in different embodiments. Furthermore, for the sake of better recognition, not all of the same elements are provided with reference symbols. Rather, the elements provided with reference symbols in the figures have been designated as representative of the other identical elements contained in the figure. This applies in particular to the elements "contact," "receiving slot," "connecting section," "force-receiving section," "terminal," and "pin". However, the same elements are readily apparent to those skilled in the art.

Figure 1:
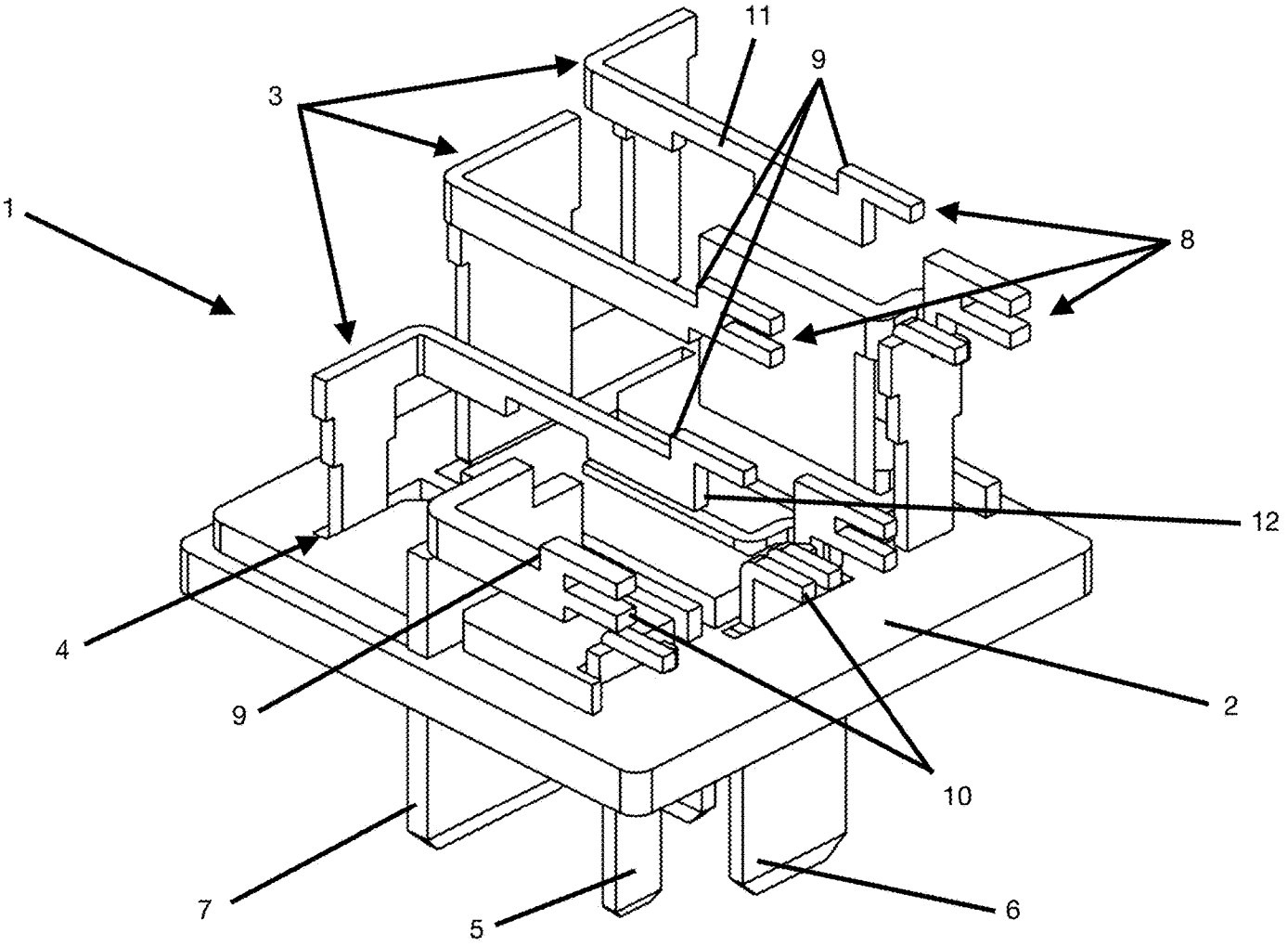
FIG. 1 shows a base plate according to a first embodiment in a perspective view with released contacts.

FIG. 1 shows a base plate 1 according to a first embodiment. The base plate 1 has a base body 2 and nine contacts 3.

The bottom plate 1 is shown with released contacts 3 which are inserted at different depths into receiving slots 4 formed in the bottom plate 1. The base body 1 has a separate slot 4 for each contact 3. The base body 1 has a substantially rectangular circumference with rounded corners. It is formed from an electrically insulating material in the form of plastic and also serves to relieve strain on the contacts 3.

The contacts 3 are designed as angled metal plates. They are preferably made of copper-plated and tin-plated steel.

Each contact 3 is designed at one end as an electrical terminal 5, 6, 7 for a relay according to the invention. The terminals 5 are designed as 2.8 mm connections. The terminal 6 is designed as a 6.3 mm connector. The terminal 7 is designed as a 9.5 mm connection.

At the other end, each contact 3 has a connecting section 8. The connecting sections 8 extend at a right angle to the respective terminal 5, 6, 7 of the contact 3.

At least one force-receiving section 9 is formed between the end 5, 6, 7 of the contact 3, designed as a terminal, and the connecting section 8. When the method is carried out as intended, at least one press punch is brought into engagement with at least one force-receiving section 9. The press punch then transmits a force perpendicular to the respective force-receiving section 9 and in the direction in which the pins 10 extend.

Each of the connecting sections 8 has at least one pin 10 for connection to a contact point on the circuit board. The number of pins is determined by the current-carrying capacity that the contacts should provide. As illustrated, five of the contacts 3 have two pins 10 and four of the contacts 3 have one pin 10. In addition to the pins 10, the connecting sections 8 have a web 11 and/or at least one contact edge 12 for the electrical connection to the printed circuit board. The webs 11 and contact edges 12 also serve to fix the contact 3 on the base body 2.

Figure 2:
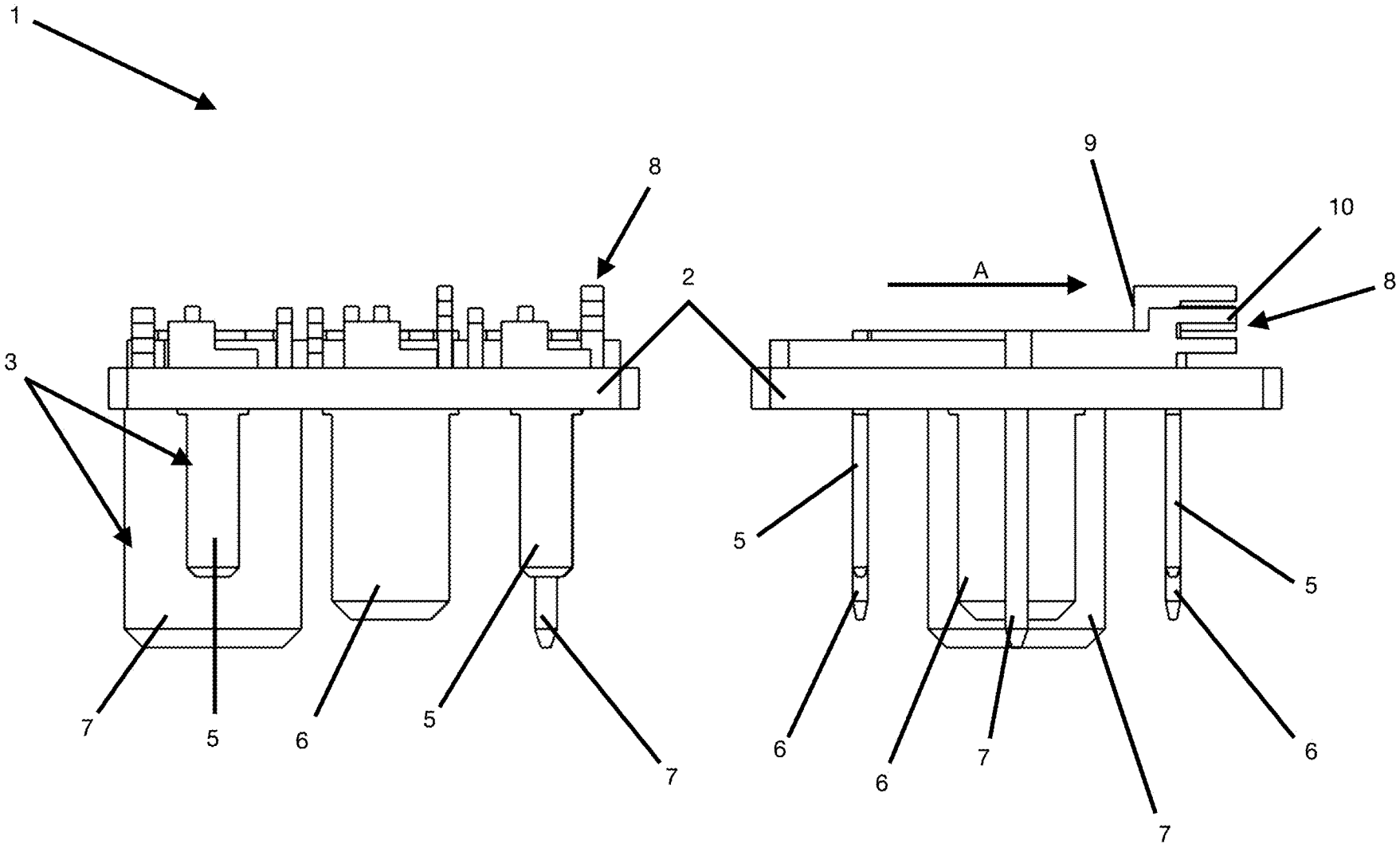
FIG. 2 shows the base plate according to FIG. 1 in different side views.

FIG. 2 shows the base plate 1 in two different side views. The contacts 3 are shown here in the fixed state. In this fixed state, the contacts 3 are pressed into the circuit board. For this purpose, the press punches are brought into engagement with the force-receiving sections 9 and a pressing force is transmitted in the pressing direction A perpendicular to the force-receiving section sections 9.

Furthermore, FIG. 2 shows the terminals 5 (2.8 mm), terminals 6 (6.3 mm) and terminals 7 (9.5 mm) formed with different dimensions. Overall, the base plate 1 has two 9.5 mm connection plugs, three 6.3 mm connection plugs and four 2.3 mm connection plugs.

Figure 3:
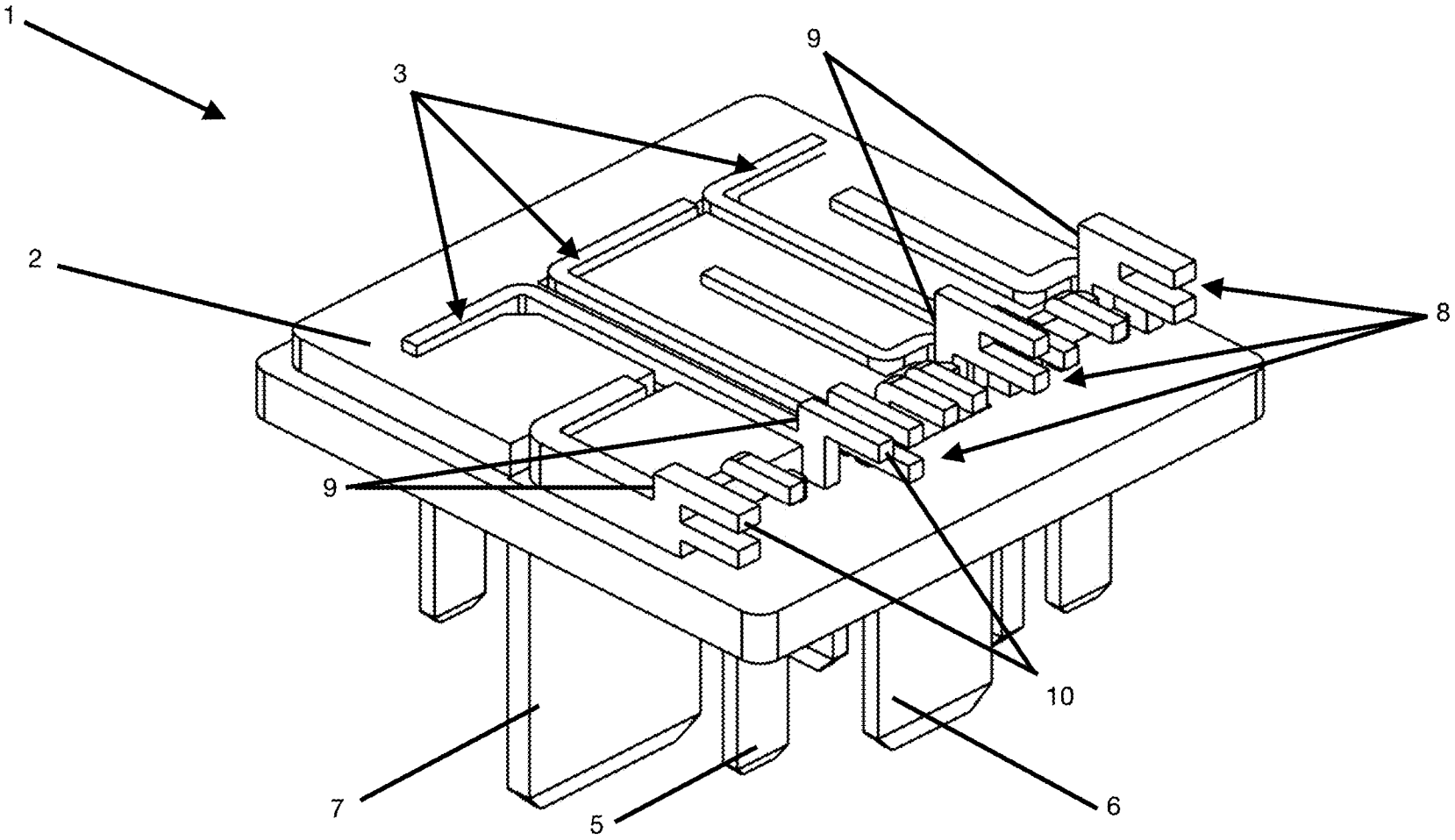
FIG. 3 shows the base plate according to FIG. 1 in a perspective view with fixed contacts.

FIG. 3 shows the base plate 1 in a perspective view. In the illustration of the base plate shown, the contacts 3 are in the fixed state on the base body.

As shown, the force-receiving sections 9 extend between the base body 2 and the respective connecting section 8 in this state.

The force-receiving sections 9 each extend at right angles to the respective connecting section 8. The force-receiving sections 9 are each formed by the narrow edges of the plate-shaped contacts 3.

FIGS. 4 to 7 show a base plate 1 according to a second embodiment. The base plate 1 has a base body 2 and nine contacts 3. The embodiments of FIGS. 1 to 3 on the one hand and FIGS. 4 to 6 on the other hand differ only in the design of the terminals 5, 6, 7 of the respective contacts 3, their arrangement and the associated features. The basic structure, however, is the same. The features of the various embodiments can therefore be easily transferred to one another and/or combined with one another.

Figure 4:
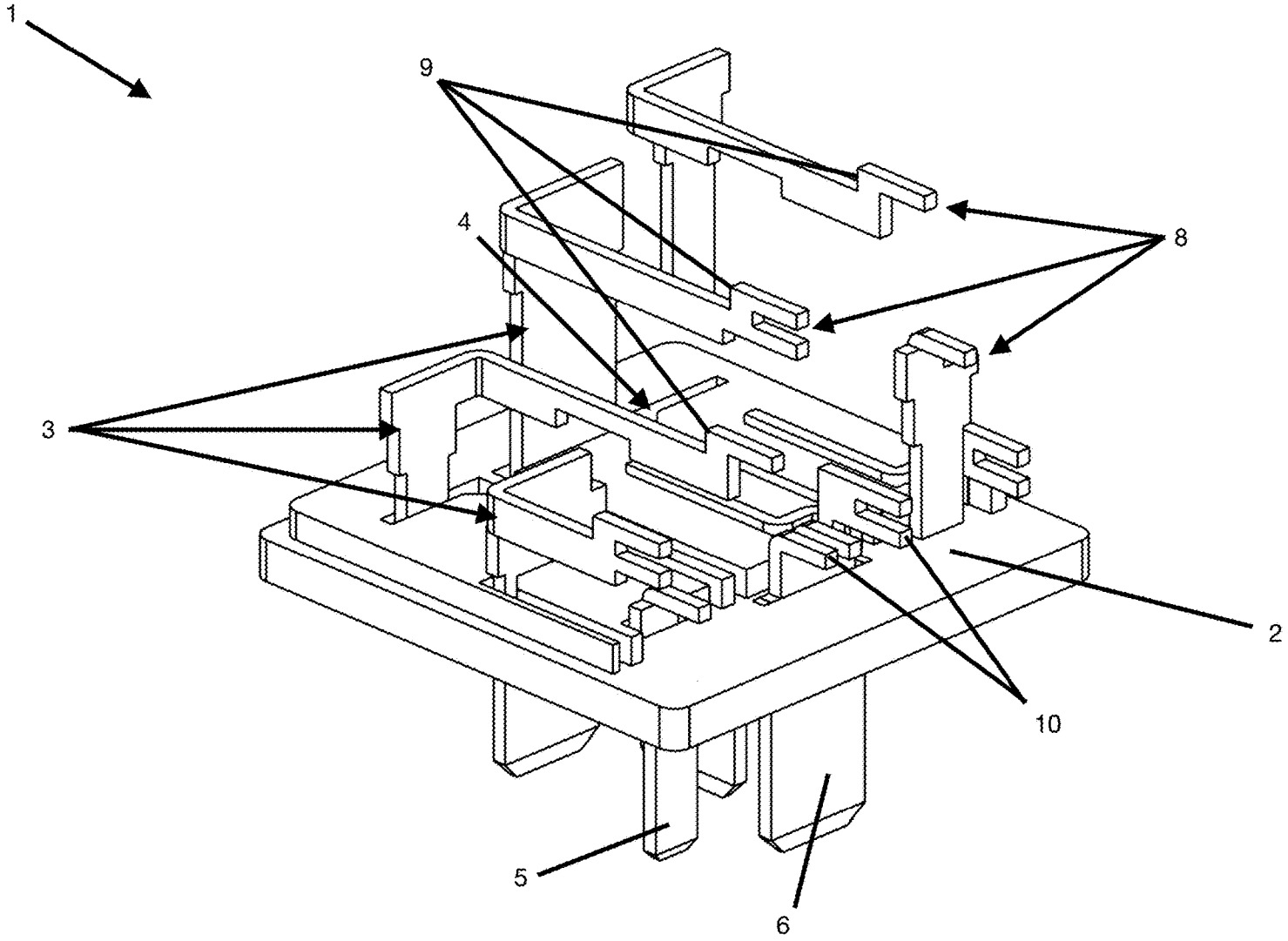
FIG. 4 shows a base plate according to a second embodiment in a perspective view with released contacts.

FIG. 4 shows the base plate 1 with released contacts 3 which are illustrated inserted at different depths into receiving slots 4 formed in the base body 2. Each contact 3 is designed at one end as an electrical terminal 5, 6 for a relay according to the invention. The terminals 5 are designed as 2.8 mm connections. The terminal 6 is designed as a 6.3 mm connector. In contrast to the embodiment according to FIG. 1, no terminal 7 with a 9.5 mm connection is provided.

Figure 5:
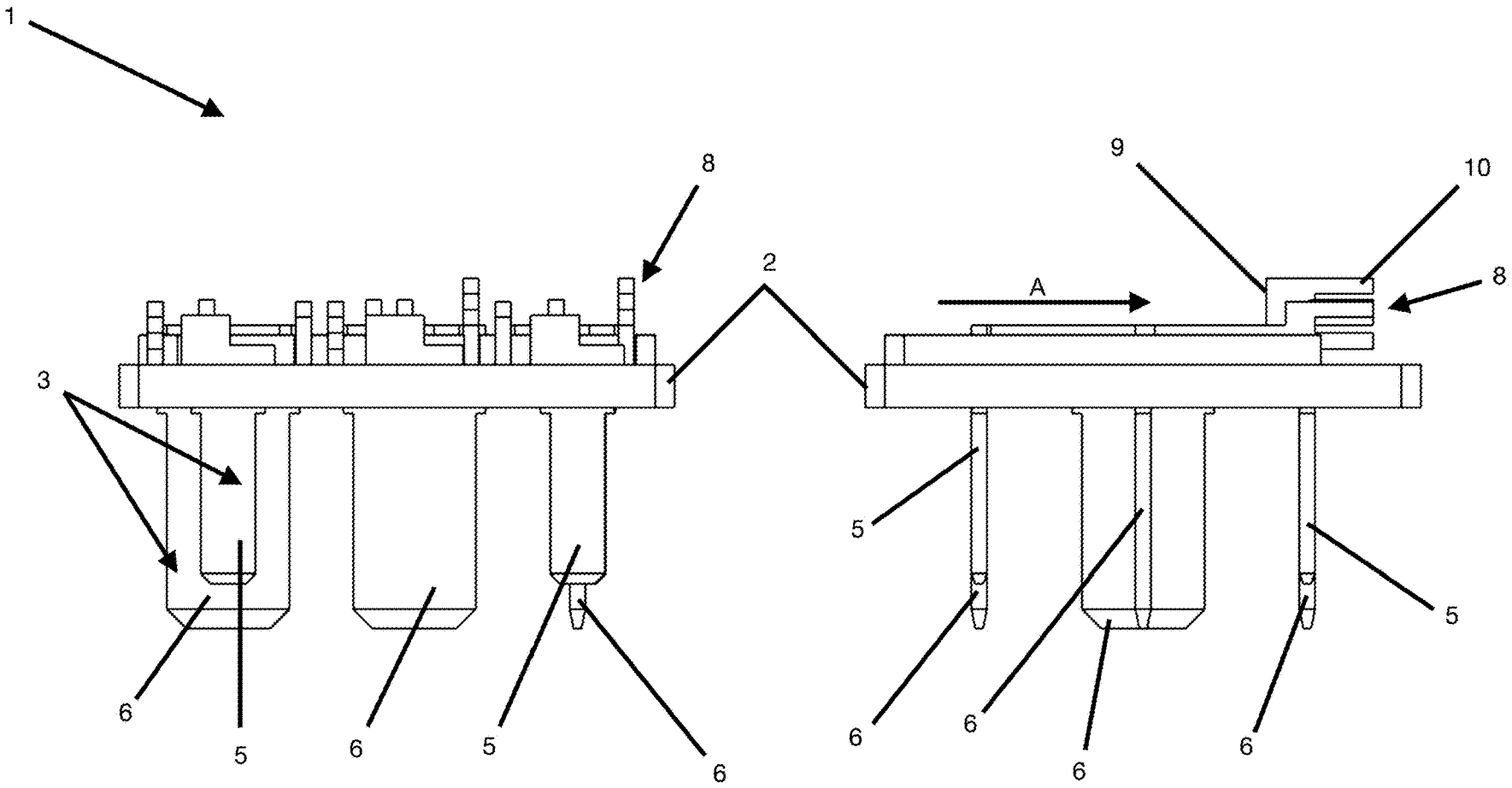
FIG. 5 shows the base plate according to FIG. 4 in different side views.

FIG. 5 shows the base plate 1 according to FIG. 4 in two different side views. The contacts 3 are shown here in the fixed state. In this fixed state, the contacts 3 are pressed into the circuit board. For this purpose, the press punches are brought into engagement with the force-receiving sections 9 and a pressing force is transmitted in the pressing direction A perpendicular to the force-receiving section sections 9.

Furthermore, the terminals 5 (2.8 mm) and terminals 6 (6.3 mm) formed with different dimensions can be seen in FIG. 5.

Figure 6:
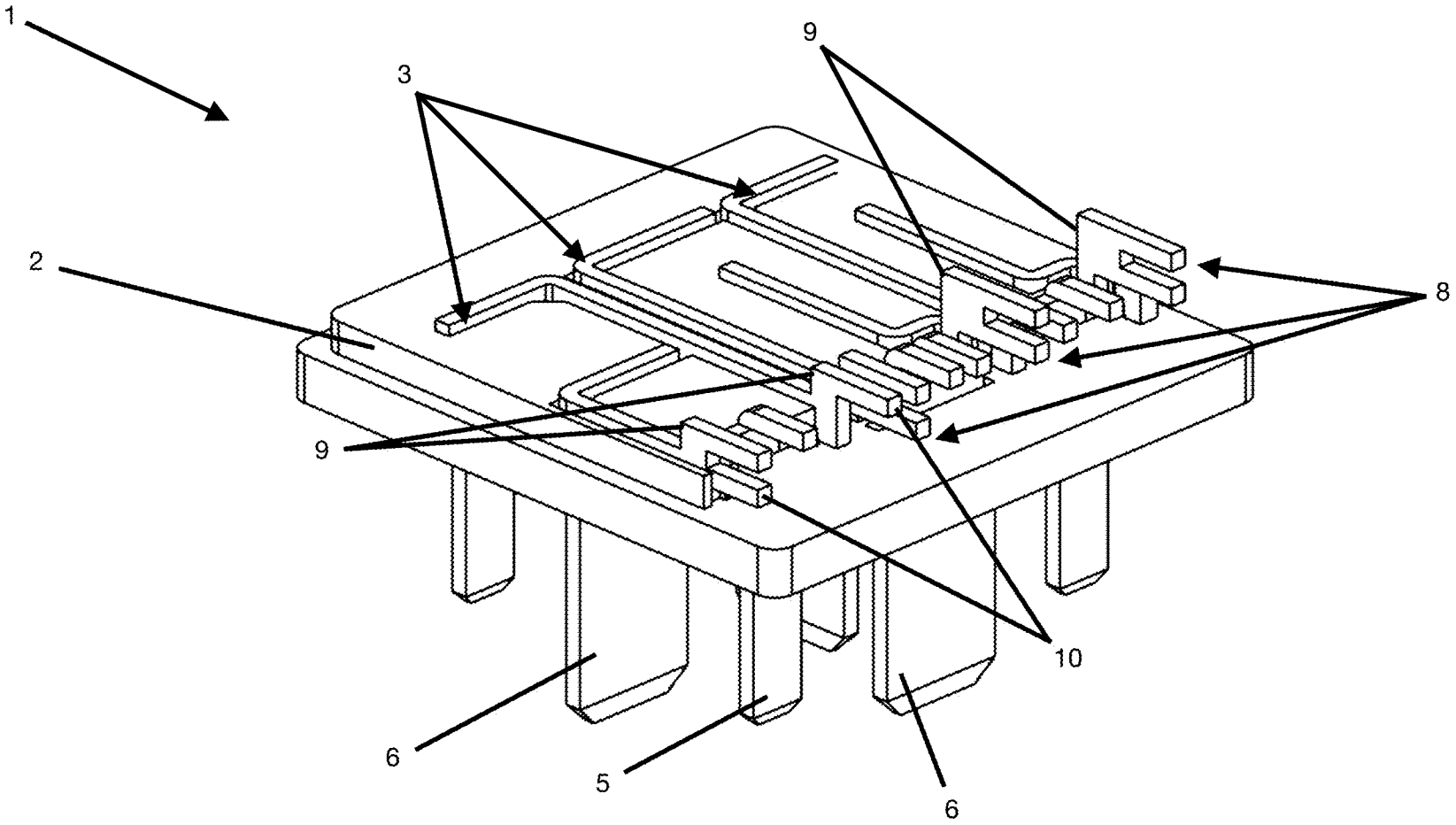
FIG. 6 shows the base plate according to FIG. 4 in a perspective view with fixed contacts.

In FIG. 6, the contacts 3 are also shown in the fixed state, in which the contacts 3 are immovably connected to the base body 2. The base body 2 has a separate slot 4 for each contact 3. The base body 2 has a substantially rectangular circumference with rounded corners. It is made of an electrically insulating material in the form of plastic.

Each of the connecting sections 8 has at least one pin 10 for the respective connection to a contact point on the circuit board.

Figure 7:
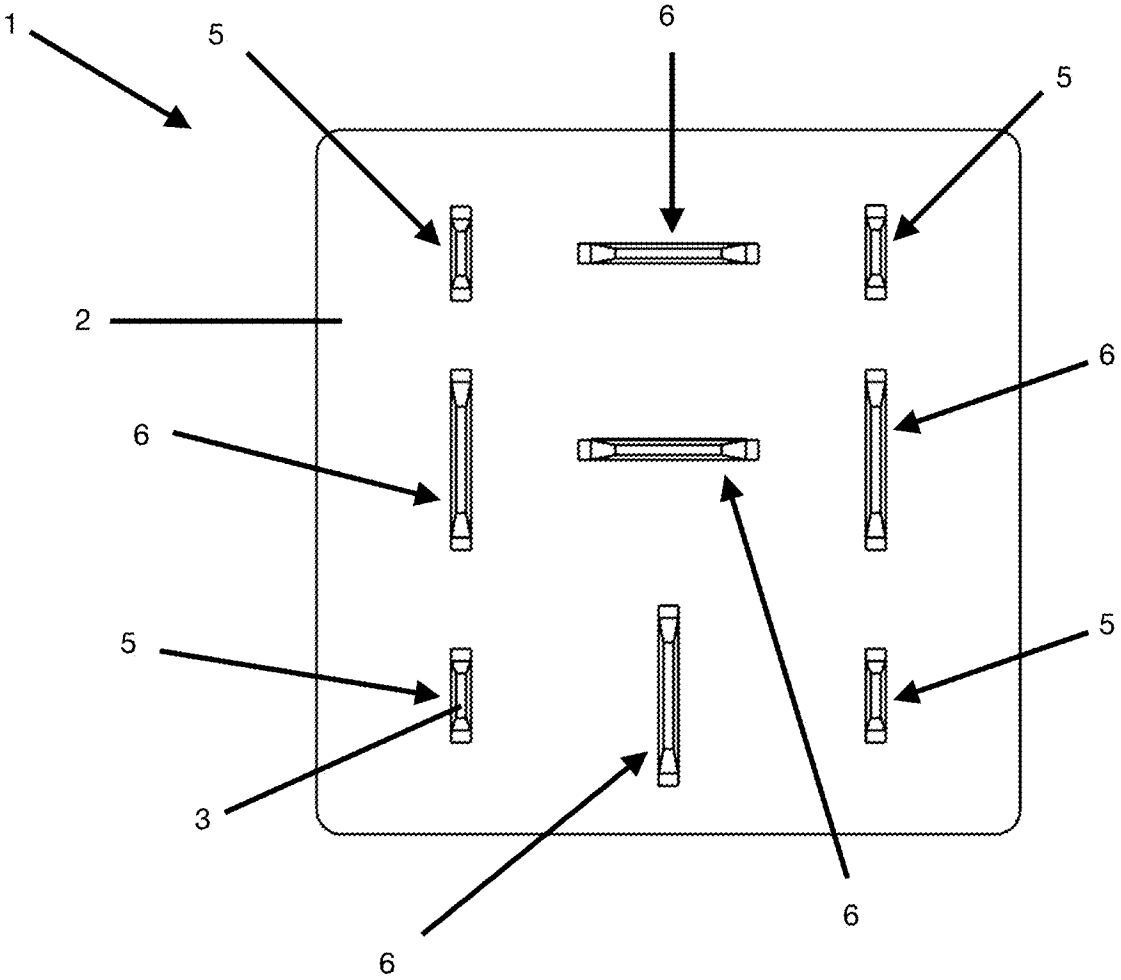
FIG. 7 shows the base plate according to FIG. 4 in view from below with fixed contacts.

FIG. 7 shows the base plate 1 in a view from below with a view of the ends of the contacts 3 designed as terminals 5, 6. In total, the base plate has five 6.3 mm terminals and four 2.3 mm terminals.

Figure 8:
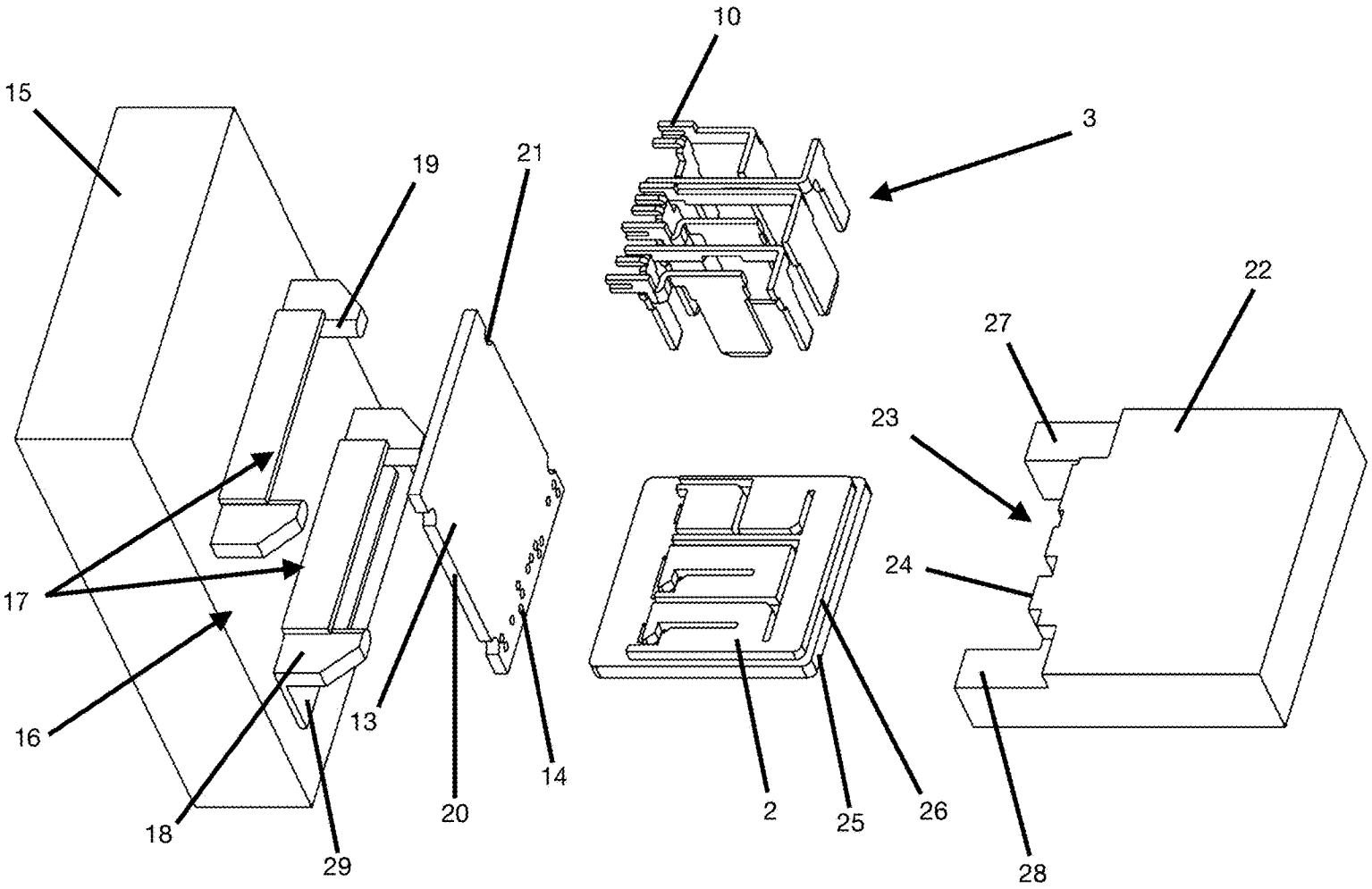
FIG. 8 shows a press-fit system in a perspective exploded view.
Figure 9:
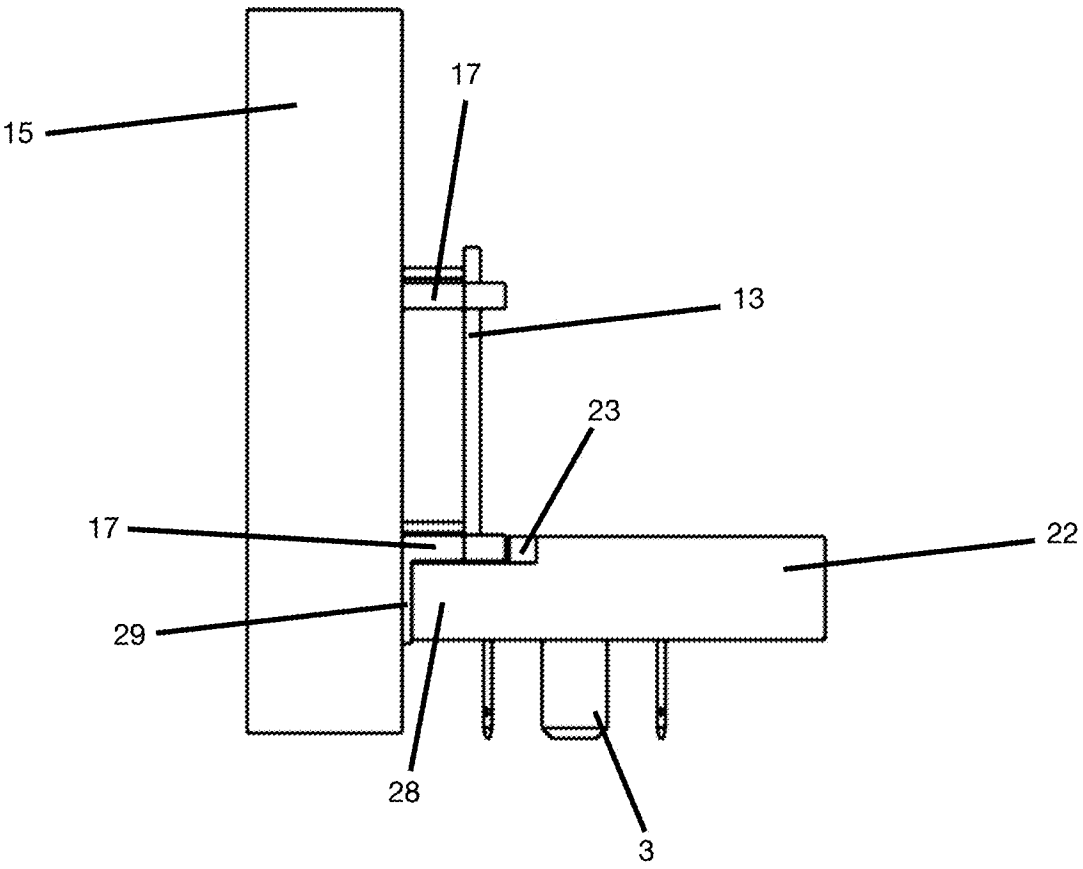
FIG. 9 shows the press-fit system according to FIG. 8 in a side pressed view.

In FIGS. 8 and 9, a press-fit system according to the invention for carrying out the press-fit method according to the invention is shown. FIG. 8 shows the components of the system in an exploded view. FIG. 9 shows the system in the pressed-in state.

The base body 2 and the contacts 3, which together form the base plate 1, can be seen.

A printed circuit board 13 is also shown. The printed circuit board 13 has a plurality of contact points in the form of holes 14. The holes 14 can at least partially be designed as bores. The pins 10 are pressed into the holes 14. Each hole 14 receives a pin 10 in the pressed-in state. The holes 14 are positioned in the printed circuit board 13 in a manner corresponding to the arrangement of the pins 10 in the fixed state.

The holes 14 have a conductive material such as copper, nickel, silver, gold or the like on the inside. The holes 14 may in particular be coated on the inside with copper. This serves, on the one hand, for the electrical connection of circuit board 13 and base plate 1. Furthermore, while the pins 10 are pressed in, part of the copper coating is removed by the pressing force acting on the contacts 3, whereby a mechanical clamping connection, in particular a force-fit connection, between hole 14 and pin 10 is created.

A first pressing device 15 can also be seen. The first pressing device 15 has a device 16 for receiving the printed circuit board 13. The device 16 is formed from two holders 17 arranged parallel to one another. Each holder 17 has a fastening web 18 on both ends. The fastening webs 18 of a holder 17 have an arc-shaped contour on their mutually facing side 19. The contour is convex.

Corresponding to the convex contour of the sides 19, a total of four circular arc-shaped concave recesses 21 are formed in the circumferential edge 20 of the circuit board 13. The printed circuit board 13 can be inserted into the device 16 in such a way that a respective fastening web 18 engages with its convex side 19 in a concave recess 21.

In addition, a second pressing device 22 is shown. The pressing device 22 is brought into engagement with the base plate 1 in order to press the contacts 3 into the circuit board 13. For this purpose, the pressing device 22 has a continuous pressing section 23. The topography of the pressing section 23 is matched to the number, arrangement, and shape of the contacts 3. The pressing section 23 thereby has sub-sections 24 which are brought into engagement with the force-receiving sections 9 during the pressing-in, in order to transmit a pressing force from the pressing device 22 to the base plate 1. Each subsection 56 forms a press punch in this embodiment.

In addition, it can be provided that pressing force is transmitted directly to the base body 2 by means of a further sub-section of the pressing section 23. For this purpose, the subsection is brought into engagement in sections with one of the two edges 25, 26 of the base body 2, which edges are arranged one above the other in a stepped manner.

The pressing device 22 may be designed as a one-piece molded part. It can in principle be made of plastic and/or metal. It may be made of metal. The pressing device 22 ensures that the pressing force is distributed particularly evenly to the base plate 1 and in particular to the contacts 3. Damage to the base plate 1, the contacts 3 and the circuit board 13 is therefore prevented.

The pressing device 22 also has two guide elements 27, 28 on the holder side. The guide elements 27, 28 are designed as rectangular projections in the pressing device 22. As intended, they serve as a centering aid and/or as an end stop during press fitting. For this purpose, they interact with one of the holders 17 in such a way that a guide element 27, 28 is guided along a fastening web 18. In the pressed-in state, the guide elements 27, 28 are in direct contact with a plate section 29 running at right angles to the fastening webs 18. In this state, they act as spacers and mark the end point of the pressing path. The guide elements 27, 28 thus ensure that the circuit board 13 is not damaged.

In addition, the plate section 29 can be designed in such a way that corresponding bores are formed below the position of the pins 10 in the pressed-in state, so that the pins 10 can penetrate there during and after the press-in process or have space and the force around the bore is absorbed can and thus the circuit board 13 is not damaged.

At the end of the press-in process, the base plate 1 and the circuit board 13 are connected to one another in such a way that their mutually facing surfaces extend at an angle of 90° to one another.

The two embodiments serve only to illustrate the invention. This expressly does not exclude other embodiments. In particular, the invention is not restricted to the use of standard dimensions for connector plugs. Rather, instead of the standardized designs with cross-sectional lengths of 2.8 mm, 6.3 mm or 9.5 mm, it is also possible to provide dimensions that differ from this, such as 2 mm, 6 mm or 10 mm. In the context of the invention, terminals with cross-sectional lengths between 1 mm and 12 mm are therefore possible in principle.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

The words "example" and "exemplary" as used herein mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A base plate for an electronic component, comprising:

a plate-shaped base body; and an electrical contact, wherein the electrical contact extends through the base body, wherein one end of the electrical contact forms an electrical terminal of the electronic component, wherein another end of the electrical contact has an electrically conductive connection section configured to be connected to a circuit board to form a permanent electrical connection without soldering, and wherein the electrical contact or the base body has a force-receiving section which extends at a right angle to the connection section.

2. The base plate as in claim 1, wherein the plate-shaped base body is made of plastic.

3. The base plate as in claim 1, wherein the electrically conductive connection section is configured to be pressed into the circuit board.

4. The base plate as in claim 1, wherein the connecting section extends, at least in some areas, essentially parallel to a flat side of the base body.

5. The base plate as in claim 1, wherein the force-receiving section extends between the base body and the connecting section.

6. The base plate as in claim 1, wherein the electrical contact is a substantially plate-shaped rod, the force-receiving section being formed by a narrow edge of the rod or as a notch.

7. An electronic component, comprising:

the base plate as in claim 1; and a circuit board, the base plate and circuit board being arranged with respect to one another such that a flat side of the base body of the base plate and a flat side of the base body of the circuit board are essentially extending at right angles to one another, wherein the circuit board comprises at least one contact point into which the connecting section of the contact of the base plate is pressed.

8. The electronic component as in claim 7, wherein the electronic component is an electronic relay.

9. The electronic component as in claim 7, wherein the contact point is a bore or a slot.

10. The electronic component as in claim 9, wherein an inside of the bore or the slot is coated with an electrically conductive metal.

11. A method for electrically and mechanically connecting the base plate and the circuit board of the electronic component as in claim 7, comprising:

arranging the base bodies of the base plate and the circuit board by a positioning device such that they are aligned at a right angle to one another and such that the connecting section of the contact of the base plate is positioned over the contact point of the circuit board so that the connecting section and contact point are aligned;

exerting, by a pressing device, a force on the force-receiving section of the base plate or the contact in the direction of the circuit board; and pressing the connecting section into the contact point to form a solder-free electrical connection between the connecting section and the contact point in a single step and mechanically fix the base plate to the circuit board.

12. The method as in claim 11, wherein the pressing device has a pressing section which is brought into engagement with the force-receiving section during the pressing.

13. A base plate for an electronic component, comprising:

a plate-shaped base body made of plastic; and an angled electrical contact, wherein the angled electrical contact extends through the base body, wherein one end of the angled electrical contact forms an electrical terminal of the electronic component, wherein another end of the electrical contact has an electrically conductive connection section configured to be pressed into a circuit board to form a permanent electrical connection without soldering, wherein the connection section and the electrical terminal are arranged perpendicular to each other, wherein the connecting section extends, at least in parts, parallel to a flat side of the base body, and wherein the angled electrical contact includes a force-receiving section which extends between the base body and the connecting section and which is arranged perpendicular to the connecting section.

* * * * *